US005595557A

United States Patent [19]

Lambert, Sr. et al.

[11] Patent Number: 5,595,557

[45] Date of Patent: Jan. 21, 1997

[54] EXERCISE MACHINE WITH TWO SETS OF PEDALS

[76] Inventors: Lloyd J. Lambert, Sr.; Lloyd J. Lambert, Jr., both of 13001 Nyack, #14558, Houston, Tex. 77089

[21] Appl. No.: 517,219

[22] Filed: Aug. 21, 1995

[51] Int. Cl.[6] ..... A63B 21/00

[52] U.S. Cl. ..... 482/57; 482/62

[58] Field of Search ..... 482/57, 58, 59, 482/60, 61, 62, 63, 148, 51

[56] References Cited

U.S. PATENT DOCUMENTS

| | | | |
|---|---|---|---|
| 2,630,332 | 3/1953 | Pettijohn | 482/62 |
| 4,283,070 | 8/1981 | Forrestall et al. | 280/274 |
| 4,402,502 | 9/1983 | Peters | 482/62 |
| 4,572,501 | 2/1986 | Durham et al. | 482/62 |
| 5,145,479 | 9/1992 | Olschensky et al. | 482/62 |

*Primary Examiner*—Stephen R. Crow

[57] ABSTRACT

An exercise machine with two sets of pedals comprising a frame of a rigid configuration positionable upon a recipient surface such as a floor. A raised support in a box-like configuration extends upwardly from the rearward portion of the frame. A seat portion is positioned upon the support for the receipt of a user. A forward set of foot pedals is secured on a first horizontal axis with respect to the frame adjacent to the forward end thereof. The pedals are adapted to be rotated by the feet of a user. A rearward set of hand pedals are secured on a second horizontal axis with respect to the support adjacent to the upper extent thereof for being held and rotated by the hands of a user. A central drive shaft is located intermediate the first axis and second axis parallel with the forward and rearward ends of the frame. Drive means couple the central drive shaft with the hand pedals and the foot pedals.

5 Claims, 5 Drawing Sheets

EXERCISE MACHINE WITH TWO SETS OF PEDALS

BACKGROUND OF THE INVENTION

1. Field of the Invention

The present invention relates to an exercise machine with two sets of pedals and, more particularly, to an exercise machine for the purpose of exercising one or more parts of the human body.

2. Description of the Prior Art

The use of an exercise machine with pedals is known in the prior art. More specifically, exercise machines heretofore devised and utilized for the purpose of exercising one or more parts of the human body through various methods and apparatuses are known to consist basically of familiar, expected, and obvious structural configurations, notwithstanding the myriad of designs encompassed by the crowded prior art which has been developed for the fulfillment of countless objectives and requirements.

By way of example, the prior art in U.S. Pat. No. 3,968,963 to Sileo discloses a chair-type exercise device with bicycle-type pedals.

U.S. Pat. No. 4,082,264 to Santos discloses a stationary exercise bicycle.

U.S. Pat. No. 4,283,070 to Forrestall et al. discloses a recumbent bicycle.

U.S. Pat. No. 5,267,923 to Piaget et al. discloses a reciprocating bellows operated machine.

Lastly, U.S. Pat. No. Des. 304,319 to Brummer discloses a recumbent bicycle.

In this respect, the exercise machine with two sets of pedals according to the present invention substantially departs from the conventional concepts and designs of the prior art, and in so doing provides an apparatus primarily developed for the purpose of exercising the human body through the coordinated movement of two arms and two legs.

Therefore, it can be appreciated that there exists a continuing need for a new and improved exercise machine with two sets of pedals which can be used for exercising the human body through the coordinated movement of two arms and two legs. In this regard, the present invention substantially fulfills this need.

SUMMARY OF THE INVENTION

In view of the foregoing disadvantages inherent in the known types of exercise machines of various designs and configurations now present in the prior art, the present invention provides an improved exercise machine with two sets of pedals. As such, the general purpose of the present invention, which will be described subsequently in greater detail, is to provide a new and improved exercise machine with two sets of pedals and method which has all the advantages of the prior art and none of the disadvantages.

To attain this, the present invention essentially comprises a new and improved exercise machine with two sets of pedals comprising, in combination, a rectangular frame of a rigid configuration positionable upon a recipient surface such as a floor. The frame has long parallel side edges and short parallel forward and rearward edges therebetween. A raised support is in a box-like configuration and extends upwardly from the rearward portion of the frame. A seat portion is positioned upon the support for the receipt of a user. A forward set of foot pedals are secured on a first horizontal axis with respect to the frame adjacent to the forward end thereof. The pedals are adapted to be rotated by the feet of a user. A rearward set of hand pedals are secured on a second horizontal axis with respect to the support adjacent to the upper extent thereof for being held and rotated by the hands of a user. A central drive shaft is located intermediate the first axis and second axis parallel with the forward and rearward ends of the frame. Axially displaced sprockets are located on the first axis and second axis respectively for coupling the hand and foot pedals with the central drive shaft. A set of axially displaced sprockets are located on the central drive shaft with chains coupling the foot and hand pedals with the drive shaft. An operator controlled adjustable transmission mechanism with a lever on the central drive shaft is provided to vary the force required to rotate the foot and hand pedals.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved exercise machine with two sets of pedals which has all the advantages of the prior art exercise machines of various designs and configurations and none of the disadvantages.

It is another object of the present invention to provide a new and improved exercise machine with two sets of pedals which may be easily and efficiently manufactured and marketed.

It is a further object of the present invention to provide a new and improved exercise machine with two sets of pedals which is of a durable and reliable construction.

An even further object of the present invention is to provide a new and improved exercise machine with two sets of pedals which is susceptible of a low cost of manufacture with regard to both materials and labor, and which accordingly is then susceptible of low prices of sale to the consuming public, thereby making such exercise machines of various designs and configurations economically available to the buying public.

Still yet another object of the present invention is to provide a new and improved exercise machine with two sets of pedals which provides in the apparatuses and methods of the prior art some of the advantages thereof, while simultaneously overcoming some of the disadvantages normally associated therewith.

Even still another object of the present invention is to exercise the human body through the coordinated movement of two arms and two legs.

Lastly, it is an object of the present invention to provide an exercise machine with two sets of pedals comprising a frame of a rigid configuration positionable upon a recipient surface such as a floor. A raised support in a box-like configuration extends upwardly from the rearward portion of the frame. A seat portion is positioned upon the support for the receipt of a user. A forward set of foot pedals is secured on a first horizontal axis with respect to the frame adjacent to the forward end thereof. The pedals are adapted to be rotated by the feet of a user. A rearward set of hand pedals are secured on a second horizontal axis with respect to the support adjacent to the upper extent thereof for being held and rotated by the hands of a user. A central drive shaft is located intermediate the first axis and second axis parallel with the forward and rearward ends of the frame. Drive means couple the central drive shaft with the hand pedals and the foot pedals.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
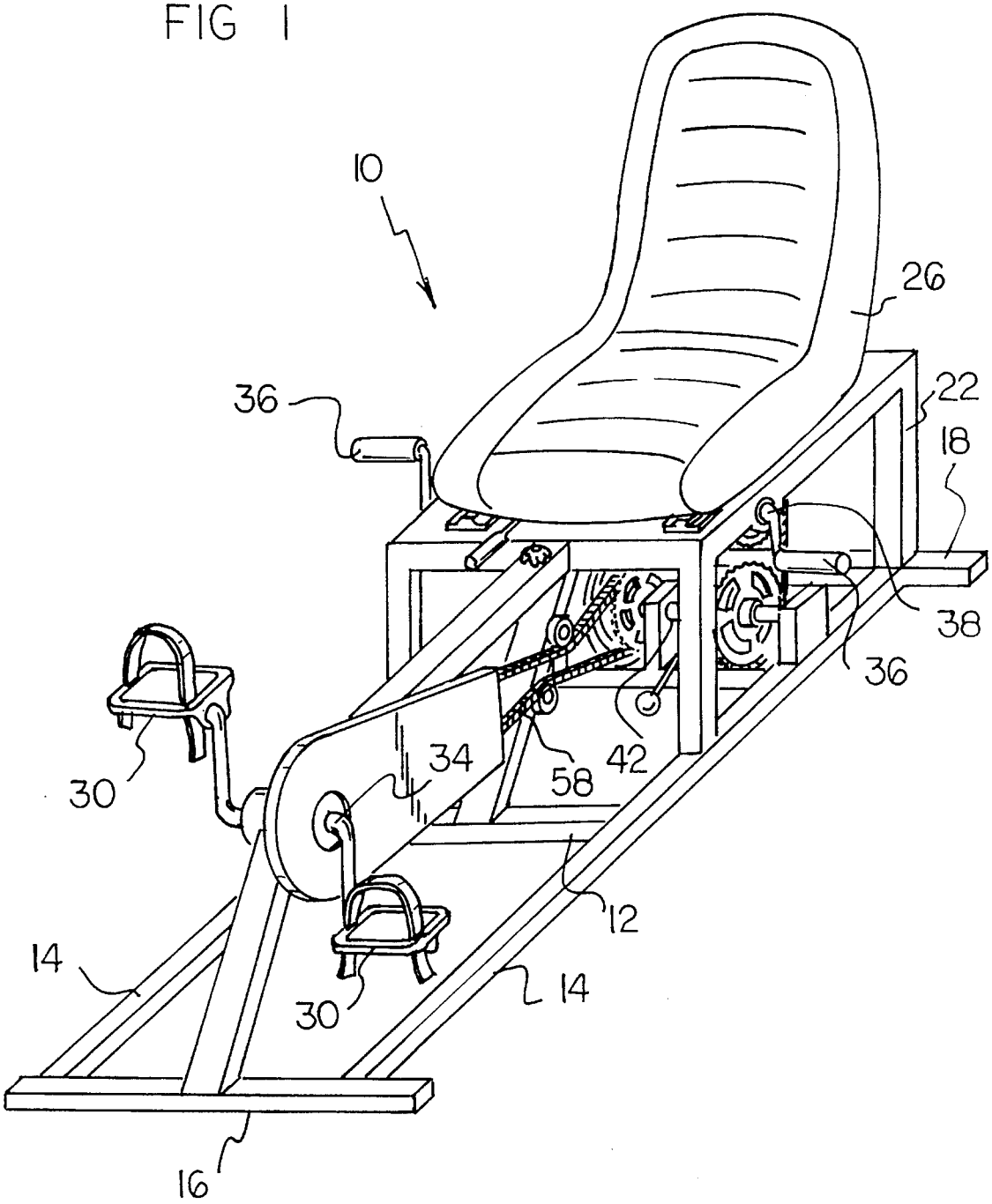
FIG. 1 is a perspective illustration of the preferred embodiment of the new and improved exercise machine with two sets of pedals constructed in accordance with the principles of the present invention.
Figure 2:
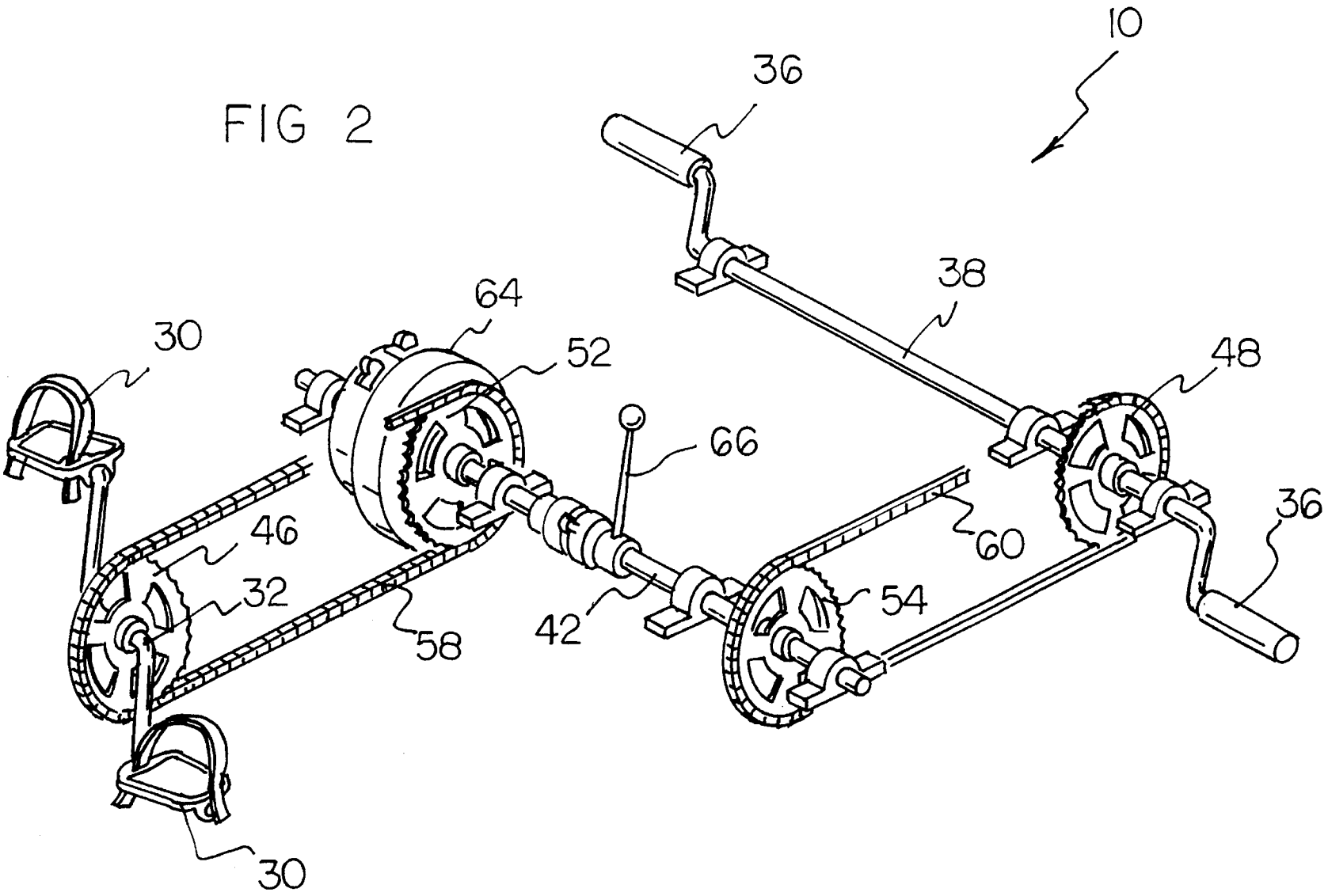
FIG. 2 is a perspective view similar to FIG. 1 but with parts removed to show certain internal constructions.

With reference now to the drawings, and in particular to FIG. 1 thereof, the preferred embodiment of the new and improved exercise machine with two sets of pedals embodying the principles and concepts of the present invention and generally designated by the reference numeral 10 will be described.

The present invention, the new and improved exercise machine with two sets of pedals, is a system 10 comprised of a plurality of components. In their broadest context, the components include a frame, a raised support, a seat, a forward set of foot pedals, a rearward set of hand pedals, a central drive shaft, an operator controlled adjustable transmission mechanism and coupling components therebetween. Each of the individual components is specifically configured and correlated one with respect to the other so as to attain the desired objectives.

More specifically, the present invention is an exercise machine 10. A central component of the system is a rectangular frame 12. The frame is of a rigid configuration. It is positionable upon a recipient surface, such as a floor. The frame has long parallel side edges 14 and short parallel forward and rearward edges 18 spanning the side edges 14.

The next component of the system 10 is a raised support 22. Such support is in a box-like configuration. It extends upwardly from the rearward portion of the frame.

Positioned upon the support is a seat 26. The seat is located on the support. The seat is configured for the receipt of a user, a person exercising on the system of the present invention.

A forward set of foot pedals 30 are next provided. Such foot pedals are secured on a first horizontal axis 32 in the forward part of the frame. Such securement is with respect to the frame in which they are journaled for rotation. The foot pedals are located adjacent to the forward end of the frame. The foot pedals are adapted to be contacted and rotated by the moving feet of the user of the system.

Operable in association with the forward set of foot pedals 30 are a rearward set of pedals, hand pedals 36. The hand pedals are secured on a second horizontal axis 38. They are rotatably journaled with respect to the raised support adjacent to the upper extent of the support. The hand pedals are for being held and rotated by the hands of a user during operation and use of the system.

In association with the hand pedals and foot pedals and their axes there is provided a central drive shaft 42. The central drive shaft is located intermediate the first axis and the second axis. It is also located parallel with the forward and rearward ends of the system.

Located on the first axis and the second axis, respectively, are an axially displaced first sprocket 46 and second sprocket 48. Such sprockets are for use in association with the operable coupling of the handle pedals and the foot pedals with the central drive shaft.

A set of axially displaced sprockets 52, 54 are located on the central drive shaft. In association therewith are drive chains 58 ad 60. The drive chains respectively couple the foot pedals and the hand pedals with the drive shaft for imparting motion.

Lastly provided is an operator controlled transmission mechanisms 46. Such transmission mechanism has a lever 66 adapted to be moved at the discretion of the user. Such lever is located on the central drive shaft. Depending on the position of the lever, the operator may vary the transmission to vary to force required by a user to rotate the foot pedals and to rotate the hand pedals.

Figure 3:
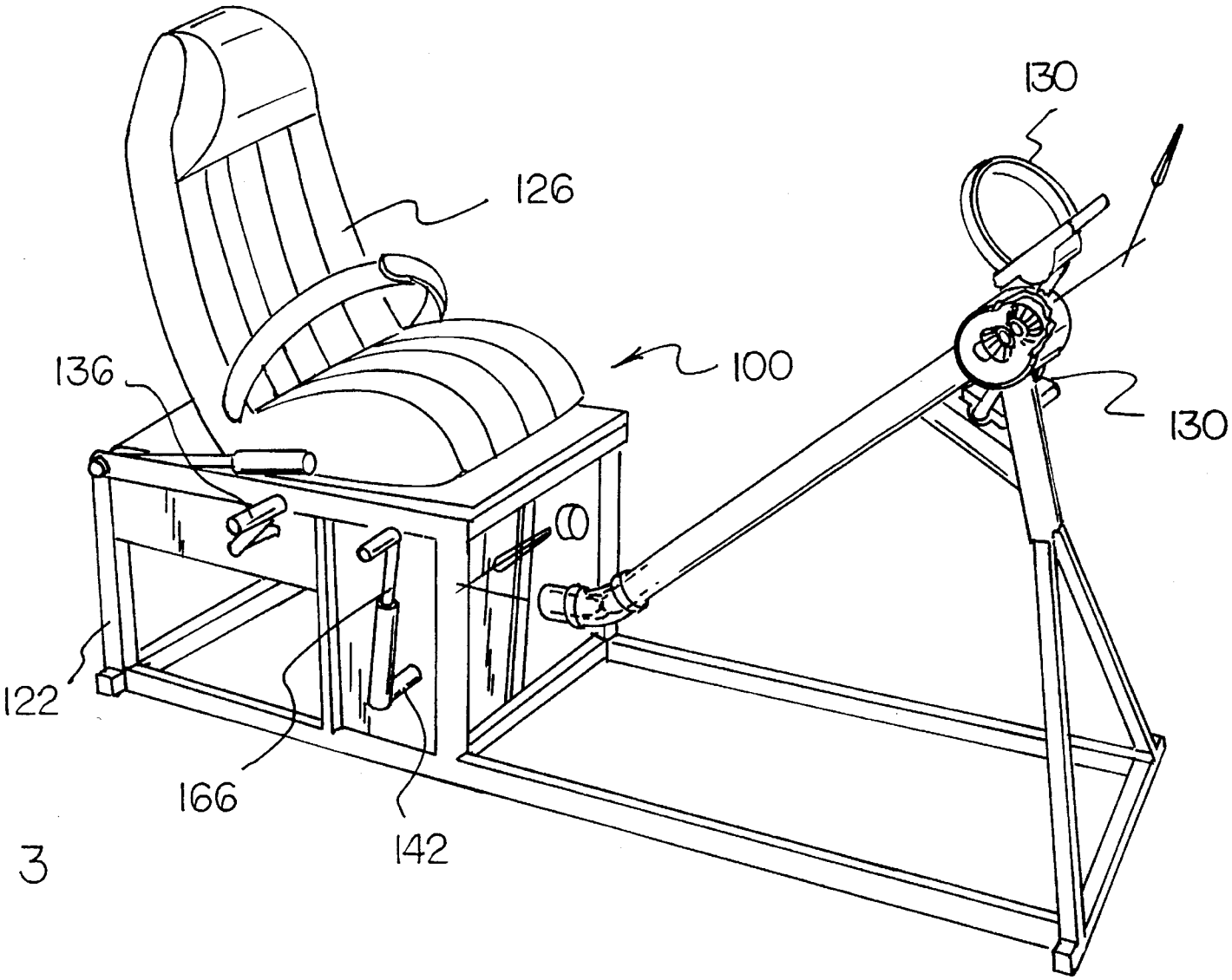
FIG. 3 is a perspective view of an alternate embodiment of the invention.
Figure 4:
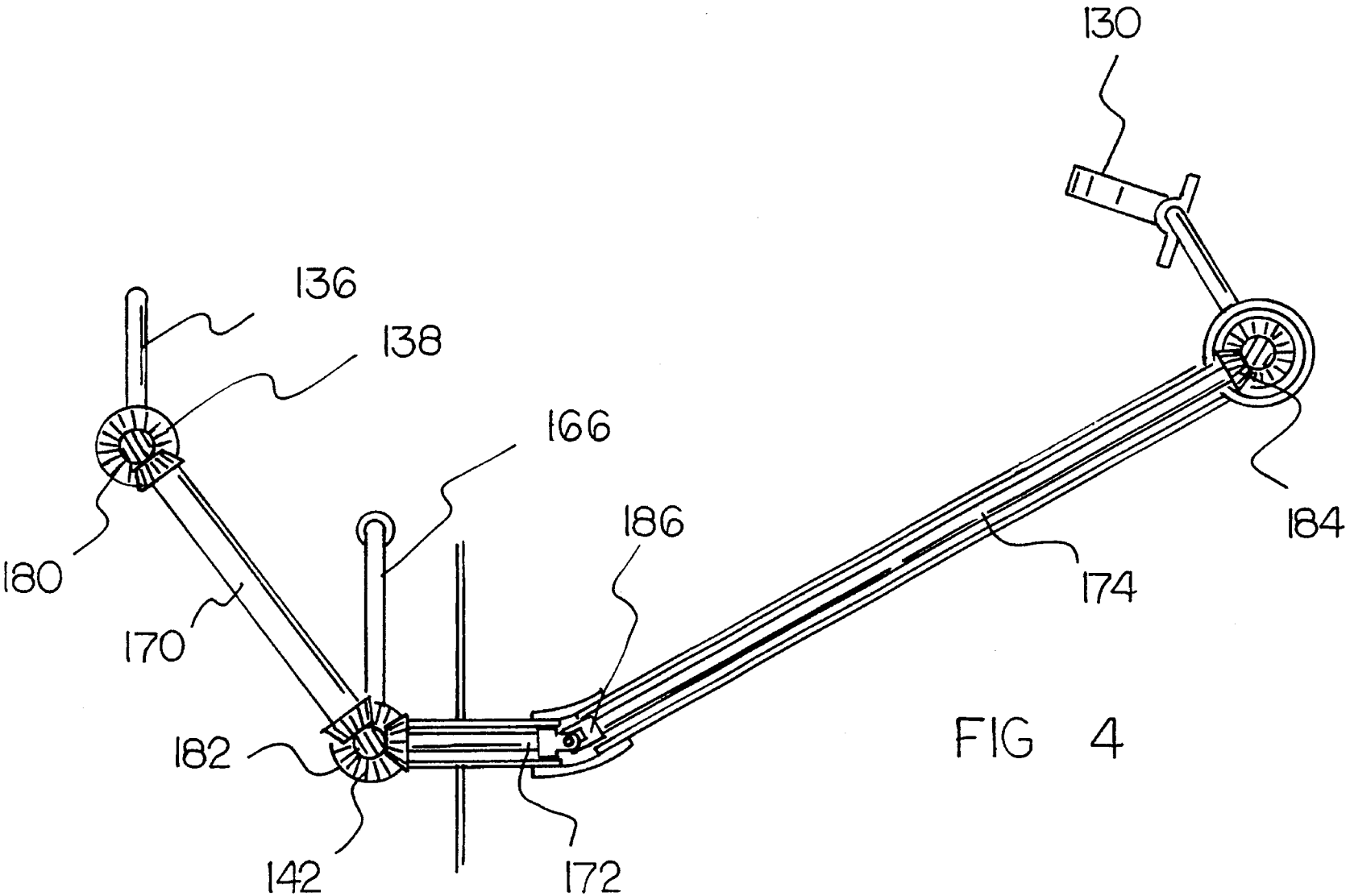
FIG. 4 is a cross-sectional view of the apparatus shown in FIG. 3.

An alternate embodiment of the invention is shown in FIGS. 3 and 4. The system 100 of such alternate embodiment includes the frame 122, the seat 126, as well as foot pedals 130 on shaft 132 and hand pedals 136 on shaft 138 along with a transmission 166 on central shaft 142. Such components are essentially the same as that described above in the description of the primary embodiment. Motion coupling between the hand pedals and foot pedals, however, is through an assembly of rotatable shafts and coupling.

More particularly, the drive includes a rearward shaft 170 rotatable about its axis coupled at its rearward end to the hand pedals. Also included is an intermediate drive shaft 172 and a forward drive shaft 174. A bevel gear assembly 180 transfers the rotation of the hand pedals 136 to drive shaft 170 at its rearward end. An intermediate gear assembly 182 couples power between the central shaft 142 and the forward end of drive shaft 170. A forward bevel gear assembly 184 couples the forward end of drive shaft 174 with the foot pedals 130. In addition, a universal joint 186 operatively couples the intermediate drive shaft 172 with the forward drive shaft 174 while allowing concurrent rotation therebetween despite the angle necessitated for the proper coupling of the various components.

As can be readily seen, the motion between the hand pedals and foot pedals are coordinated as in the prior embodiment except that the drive between the hand and foot pedals and the remainder of the machine is done through bevel gears and a shaft rather than through chains as in the primary embodiment.

Figure 5:
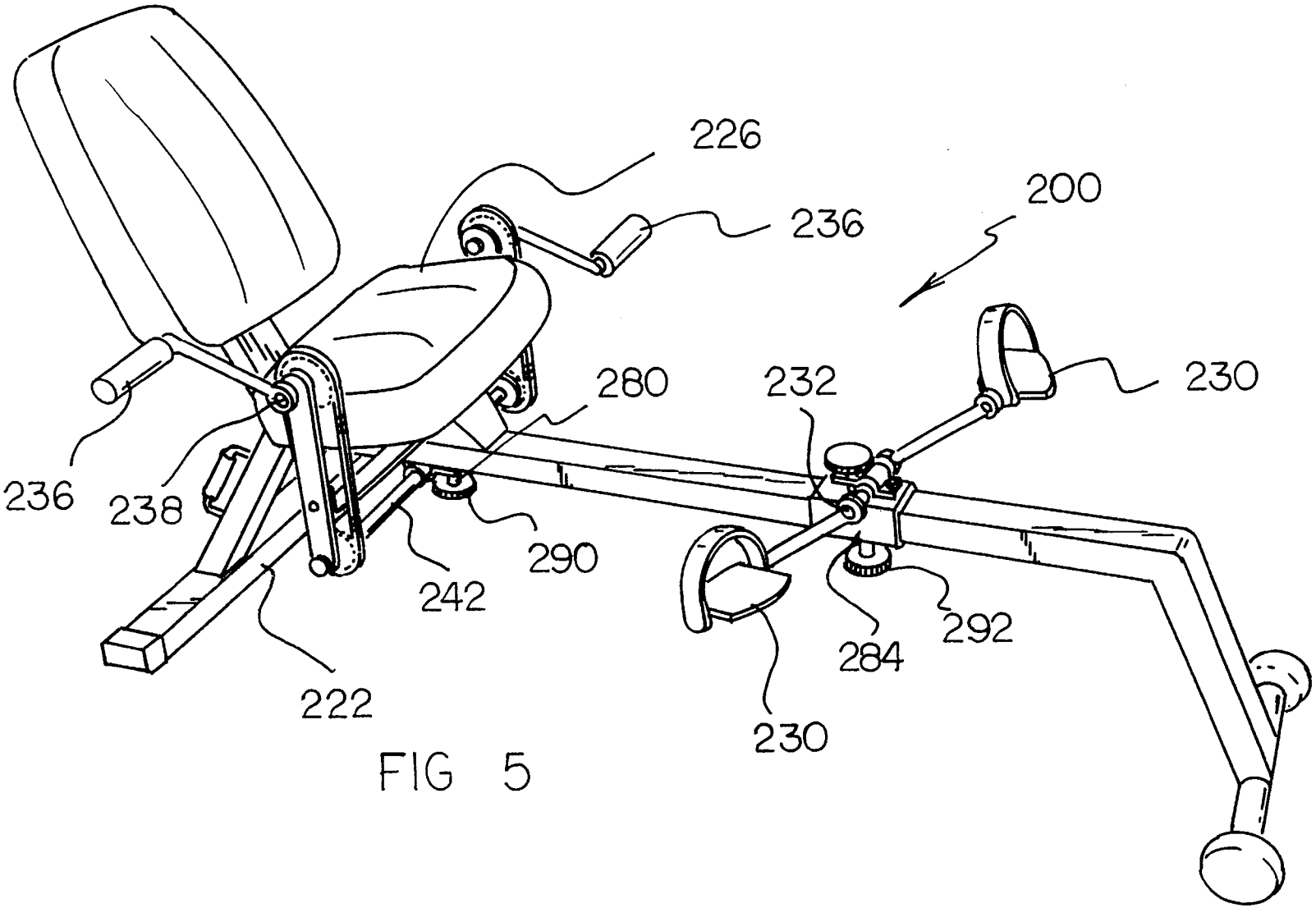
FIG. 5 is a perspective illustration of yet a further alternate embodiment of the invention.

An additional alternate embodiment of the invention is shown in FIG. 5. The system 200 of such alternate embodiment includes a frame 222, the seat 226, as well as the foot pedals 230 on shaft 232 and hand pedals 236 on shaft 238. Such components are essentially the same as that described above in the first two embodiments. There are, however, no motion coupling mechanisms between the hand pedals and foot pedals.

More particularly, as in the prior embodiments, the drive assembly includes rearward drive shafts 238 for rotation upon a user rotating the hand pedals 236. Rotation of the drive shafts 238 will rotate shaft 242 through chains coupling gears on the shafts. Shaft 242 is supported at its center through a metal strap in which it is journaled. The strap is held to the frame through adjustable bolt 280 which has a rotatable handle 290. Rotation of the handle in one direction will tighten the strap around the shaft 242 while rotation of the handle in the other direction will loosen the strap with respect to the shaft 242. In this manner, the force of the user's hands to move the hand pedals during operation and use may be varied for a particular exercise regimen.

The drive assembly also includes a forward drive shaft 232 for rotation upon a user rotating the foot pedals 230. Shaft 232 is supported at its center through a metal strap in which it is journaled. The strap is held to a slidable collar 284 on the frame through adjustable bolt 288 which has a rotatable handle 288. Rotation of the handle in one direction will tighten the strap around the shaft 232 while rotation of the handle in the other direction will loosen the strap with respect to the shaft 232. In this manner, the force of the user's feet to move the foot pedals during operation and use may be varied for a particular exercise regimen. Note is taken that the hand and foot pedals are adjustable to a desired tension independently of each other through handles 290 and 292.

The FIG. 5 embodiment also provides for an adjustment to accommodate users of various sizes. Such adjustment is accomplished through the collar 284 surrounding the vertical shaft portion of the frame upon which it is slidably mounted. The collar 284 has an upper surface upon which the shaft 232 and its supporting strap are mounted in a manner similar that for the shaft 242 and its associated collar at the rearward end as described above. In its lower surface, the collar 284 has a threaded aperture in which a threaded bolt is rotatably coupled. The bolt has a downwardly extending rotatable handle 284. Rotation of the handle 292 in one direction will move its associated bolt away from the adjacent vertical shaft portion of the frame to allow for the free sliding of the collar as well as the shaft 232 and foot pedals toward or away from the hand pedals 236. Rotation of the handle 292 in the other direction will move its associated bolt into contact with the adjacent vertical shaft portion of the frame to preclude movement of the collar as well as the shaft 232 and foot pedals and thereby lock such components in the desired position. This arrangement thus allows adjustment of the position of the foot pedals with respect to the hand pedals to suit the needs and desires of the particular user.

As can be readily seen from FIG. 5 when compared with the prior Figures, such embodiment is a more economical version of the prior embodiments.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by letters patent of the United States is as follows:

1. A new and improved stationary exercise machine with two sets of pedals comprising, in combination:

a rectangular frame of a rigid configuration positionable upon a recipient surface such as a floor, the frame having long parallel side edges and short parallel forward and rearward edges therebetween;

a raised support in a box-like configuration extending upwardly from the rearward portion of the frame;

a seat portion positioned upon the support for the receipt of a user;

a forward set of foot pedals secured on a first horizontal axis with respect to the frame adjacent to the forward end thereof, the pedals adapted to be rotated by the feet of a user;

a rearward set of hand pedals secured on a second horizontal axis with respect to the support adjacent to the upper extent thereof for being held and rotated by the hands of a user;

a central drive shaft located intermediate the first axis and second axis parallel with the forward and rearward ends of the frame;

axially displaced sprockets on the first axis and second axis respectively for coupling the hand and foot pedals with the central drive shaft;

a set of axially displaced sprockets on the central drive shaft with chains coupling the foot and hand pedals with the drive shaft; and an operator controlled adjustable transmission mechanism with a lever on the central drive shaft to vary the force required to rotate the foot and hand pedals.

2. A stationary exercise machine with two sets of pedals comprising:

a frame of a rigid configuration positionable upon a recipient surface such as a floor;

a raised support in a box-like configuration extending upwardly from the rearward portion of the frame;

a seat portion positioned upon the support for the receipt of a user;

a forward set of foot pedals secured on a first horizontal axis with respect to the frame adjacent to the forward end thereof, the pedals adapted to be rotated by the feet of a user;

a rearward set of hand pedals secured on a second horizontal axis with respect to the support adjacent to the upper extent thereof for being held and rotated by the hands of a user;

a central drive shaft located intermediate the first axis and second axis parallel with the forward and rearward ends of the frame; and drive means coupling the central drive shaft with the hand pedals and the foot pedals and further including an operator controlled adjustable transmission mechanism with a lever on the central drive shaft to vary the force required to rotate the foot and hand pedals.

3. The system as set forth in claim 2 and further including axially displaced sprockets on the first axis and second axis respectively for coupling the hand and foot pedals with the central drive shaft and a set of axially displaced sprockets on the central drive shaft with chains coupling the foot and hand pedals with the drive shaft.

4. The device as set forth in claim 2 and further including means to independently adjust the force require to rotate the hand pedals and the foot pedals.

5. The device as set forth in claim 2 wherein foot pedals are movable towards and away from the hand pedals.

* * * * *